US006886772B2

(12) United States Patent
Hirata et al.

(10) Patent No.: US 6,886,772 B2
(45) Date of Patent: May 3, 2005

(54) WEB SPLICING METHOD AND WEB SPLICING APPARATUS

(75) Inventors: Tsugio Hirata, Osaka (JP); Yoshinobu Oyagi, Kyoto (JP)

(73) Assignee: Zuiko Corporation, Osaka (JP)

( * ) Notice: Subject to any disclaimer, the term of this patent is extended or adjusted under 35 U.S.C. 154(b) by 27 days.

(21) Appl. No.: 10/430,103

(22) Filed: May 5, 2003

(65) Prior Publication Data

US 2003/0209629 A1 Nov. 13, 2003

(30) Foreign Application Priority Data

May 10, 2002 (JP) ..... 2002-134930

(51) Int. Cl.[7] ..... B65H 19/20
(52) U.S. Cl. ..... 242/554.2; 242/420.5
(58) Field of Search ..... 242/420.5, 420.6, 242/421.7, 552, 554.5, 554.2, 559.3

(56) References Cited

U.S. PATENT DOCUMENTS 3,822,838 A 7/1974 Butler, Jr. et al.
3,836,089 A 9/1974 Riemersma
4,038,805 A * 8/1977 Holladay et al.
4,374,576 A * 2/1983 Ryan
4,949,910 A * 8/1990 Kleitz et al. ..... 242/552
5,190,234 A * 3/1993 Ezekiel ..... 242/552
5,273,228 A * 12/1993 Yoshida et al. ..... 242/552
5,411,223 A * 5/1995 Gatteschi ..... 242/552
5,671,895 A * 9/1997 Cederholm et al. ..... 242/420.6
6,547,708 B2 * 4/2003 Kawamura et al.
6,676,062 B1 * 1/2004 Herhaus ..... 242/420.6

FOREIGN PATENT DOCUMENTS

DE 43 12 534 A 1 1/1995
JP 10045290 2/1998

OTHER PUBLICATIONS

European Search Report, Application No. EP 03 10 1292, Filing Date Aug. 28, 2003, two pages.

* cited by examiner

*Primary Examiner*—William A. Rivera
(74) *Attorney, Agent, or Firm*—Eschweiler & Associates, LLC

(57) ABSTRACT

The present invention provides a web splicing method and a web splicing apparatus with which a line velocity on an output side of the splicing apparatus does not fluctuate through a web splicing operation. The method and apparatus are further operable to maintain a line velocity at a predetermined velocity after the web splicing operation. The method of the present invention includes the steps of: connecting a second web Wb fed out from a second roll B to a first web Wa; cutting off the first web Wa at a position between a point at which the second web Wb is connected to the first web Wa and a first roll A; spinning the second roll B to feed out the second web Wb; obtaining a value of a diameter of the second roll B based on a state of an accumulator 4; and controlling a circumferential velocity of the second roll B based on the obtained diameter.

16 Claims, 2 Drawing Sheets

WEB SPLICING METHOD AND WEB SPLICING APPARATUS

FIELD OF THE INVENTION

The present invention relates to a web splicing method and a web splicing apparatus.

BACKGROUND OF THE INVENTION

Japanese Laid-Open Patent Publication No. 10-45290 discloses an automatic web splicing apparatus for splicing a web with another web while maintaining a constant tension on the web. With the conventional apparatus, the web velocity is detected by a line pulse generator on the output side of the automatic splicing apparatus to calculate the diameter of a roll of web based on the web velocity, or the like, and the braking force is controlled based on the diameter of the roll, or the like, thereby maintaining a constant torque. However, maintaining a constant line velocity on the output side of the automatic splicing apparatus is not taken into consideration.

SUMMARY OF THE INVENTION

Thus, it is an object of the present invention to provide a web splicing method and a web splicing apparatus with which the line velocity on an output side of the splicing apparatus does not fluctuate through a web splicing operation, and the line velocity can be kept at a predetermined velocity even after the web splicing operation.

In order to achieve the object set forth above, a splicing method of the present invention includes the steps of: spinning a first roll of web to feed out a first web so as to store a predetermined length of the first web in an accumulator; stopping the spinning of the first roll; connecting a second web fed out from a second roll of web to the first web; cutting off the first web at a position between a point at which the second web is connected to the first web and the first roll; spinning the second roll to feed out the second web after the first web is cut off; obtaining a diameter of the second roll based on a state of the accumulator; and controlling a circumferential velocity of the second roll based on the obtained diameter.

With this splicing method, the circumferential velocity of the second roll, i.e., a flow velocity of the second web to be supplied to the accumulator, is controlled based on the diameter of the second roll, which is connected to an end of the first web. Therefore, a tension on the first and second webs being fed to the accumulator is kept at a predetermined value irrespective of the diameter of the second roll, and the first and second webs can be output from the accumulator at a constant velocity, even during the web splicing operation.

While the diameter of the second roll may be obtained by directly measuring the diameter of the second roll, it requires an expensive measurement device. In view of this, the diameter of the second roll may be calculated from a position of a movable roller associated with the accumulator, as in the following splicing apparatus.

A splicing apparatus of the present invention includes: a first driver capable of spinning a first roll of web; a second driver capable of spinning a second roll of web; a splicer for connecting a second web fed out from the second roll to a first web fed out from the first roll, and cutting off the first web; an accumulator provided downstream of the splicer capable of storing the first web or the second web; a sensor capable of measuring a position of a movable roller; and a controller for controlling a rotational speed of the first driver and that of the second driver. The controller is operable to calculate the diameter of the second roll based on a positional change of the movable roller, information regarding an angular velocity of the second driver and a web flow velocity at a position downstream of the accumulator. The controller is further operable to calculate an appropriate rotational speed of the second driver based on the diameter of the second roll. The controller is yet further operable to control the connecting and cutting operation of the splicer while controlling the second driver according to the appropriate rotational speed.

A change in an amount of the web stored in the accumulator can be determined from a positional change of the movable roller. Specifically, when the first or second driver is moving away from a fixed roller associated with the accumulator, the velocity at which the web is fed out from the first or second respective roll is greater than the velocity at which the web is output from the accumulator (e.g., a line velocity), thereby increasing the amount of the web stored in the accumulator. On the other hand, when the movable roller is moving toward the fixed roller, the velocity at which the web is fed out from the first or second roll is less than the line velocity, thereby decreasing the amount of the web stored in the accumulator. Thus, when the velocity at which the web is fed out from the first or second roll is greater than the line velocity, the amount of the web stored in the accumulator increases, whereas when the velocity at which the web is fed out from the first or second roll is smaller than the line velocity, the amount of the web stored in the accumulator decreases.

Therefore, there is a predetermined relationship between the positional change of the movable roller (the change per unit time: the velocity of the movable roller) and the velocity at which the web is fed out from the respective roll.

Moreover, the velocity at which the web is fed out from the respective roll is equal to the diameter of the roll multiplied by the angular velocity of the respective driver, whereby the diameter of the roll can be known from the positional change of the movable roller, the line velocity and the angular velocity.

In the present invention, the term "information regarding the angular velocity of a driver" is not limited to the angular velocity of a motor associated with the roll of web, but may also be, for example, the angular velocity of a shaft associated with the roll of web.

In the present invention, the position of the movable roller may be measured by detecting the movable roller itself, but may alternatively be measured by detecting a position of a frame that rotatably supports the movable roller.

DESCRIPTION OF THE PREFERRED EMBODIMENTS

One embodiment of the present invention will now be described with reference to the drawings.

Figure 1:
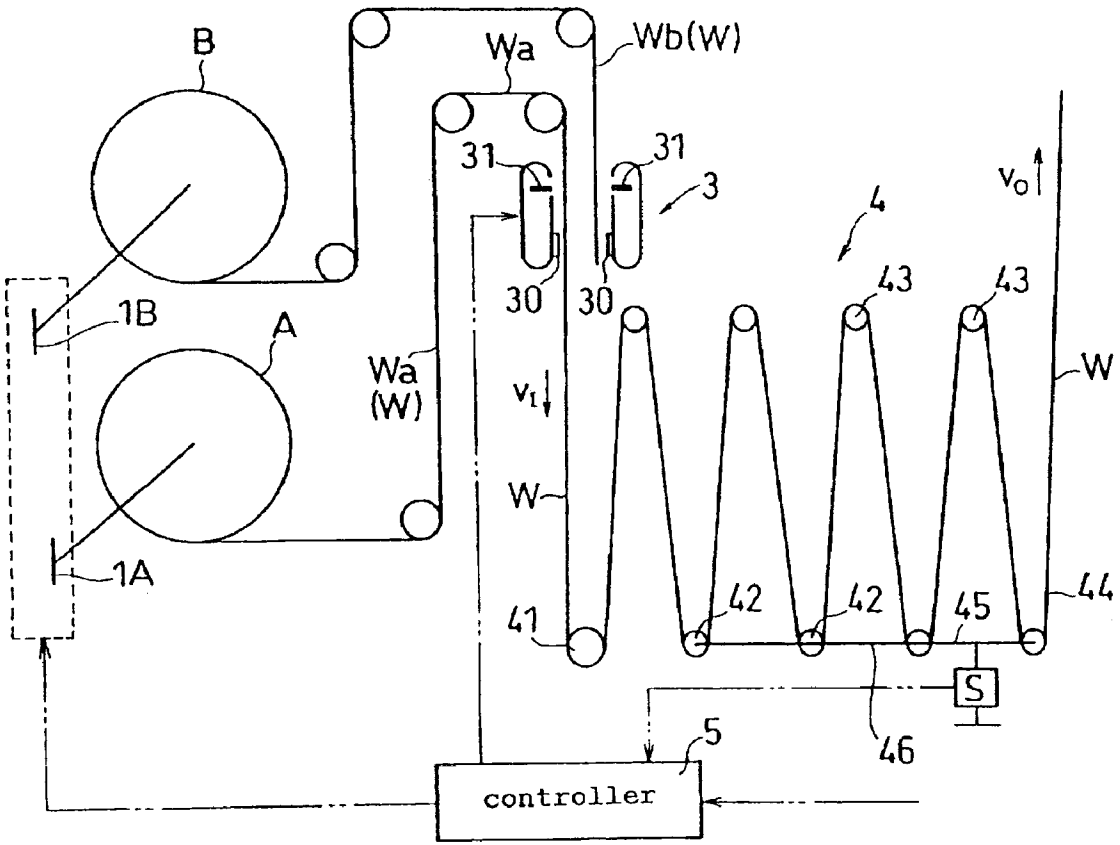
FIG. 1 is a schematic of a web splicing apparatus according to one embodiment of the present invention.

A splicing apparatus illustrated in FIG. 1 alternately transfers a first web Wa fed from a first roll A and a second web Wb fed from a second roll B while connecting the first web Wa and the second web Wb together. The splicing apparatus includes a first driver 1A for spinning the first roll A, a second driver 1B for spinning the second roll B, a splicer 3, and an accumulator 4.

The first driver 1A and the second driver 1B may be driven separately by independent motors (not shown), or by a single motor while switching the connection therebetween by a clutch (not shown), or the like. Note that the web W is moving at a velocity $V_O$ by a driver (not shown). For example, when the driver is connected to a motor, a predetermined signal may be issued for each turn of the motor, based on which the velocity $V_O$ can be known. Such a motor may be a servo motor, or the motor that be vector-controlled. Alternatively, the velocity $V_O$ can be known by measuring an amount of rotation of the driver itself with an encoder.

The splicer 3 includes a connection section 30 for connecting together the first web Wa fed from the first roll A and the second web Wb fed from the second roll B while lapping the first web and the second web over each other. The connection section 30 may sandwich the first web Wa and the second web Wb and connect them together by a heat seal or an ultrasonic seal. Alternatively, an adhesive or a double-sided adhesive tape may be applied on one side of the second web Wb before the second web Wb is inserted into the connection section 30.

In the splicer 3, after connecting together the first web Wa and the second web Wb, one of the webs W (the first web Wa or the second web Wb) is cut off at a position between the splicer 3 and the roll A (B). For example, when an amount of the first web Wa wound around the first roll A or the second web Wb wound around the second roll B becomes less than a predetermined amount, the connection section 30 connects the first web Wa and the second web Wb together, and then one of the webs W (the respective first web Wa or the second web Wb) is cut off at a position upstream of the connection section 30 with a cutter 31 such as a heat cutter, an ultrasonic cutter, a laser cutter, or the like. For example, the cutter 31 for cutting the web W may be a cutting tool protruding from the splicer 3 toward the web W. After the first web Wa or the second web Wb is cut off, the connection section 30 opens up to release the webs Wa and Wb. In this way, the web W flowing after the splicer 3 is switched between the respective first web Wa and the second web Wb.

An accumulator 4 includes a plurality of movable rollers 42 and a plurality of fixed rollers 43, around which the web W is passed, and a frame 45, to which the movable rollers 42 are attached. The web W may be placed under tension by a self-weight of the frame 45, etc. Alternatively, an elastic member (not shown) such as a spring or a damper, or a weight, may be attached to the frame 45 for applying a predetermined tension on the web W.

In the accumulator 4, the web W is passed around a web-receiving section 41 for receiving one of the webs W, the movable rollers 42, and the fixed rollers 43 in a zigzag pattern, and the web W is placed under a predetermined tension as the movable rollers 42 connected together via the frame 45 are moved up and down. For example, when more web W is supplied to the accumulator 4 than is output, the movable rollers 42 are moved away from the fixed rollers 43. On the other hand, when more web W is output from the accumulator 4 than is supplied, the movable rollers 42 are moved toward the fixed rollers 43. In other words, the accumulator 4 can store a predetermined or controllable length of the web W, and the web W can be output from an output section 44 even if the flow velocity of the web W is zero at the position of the web-receiving section 41. As a result, the tension on the web W can be kept at a predetermined value.

Moreover, as the number of the movable rollers 42 and the fixed rollers 43 is larger, more web W can be stored in the accumulator 4. However, as the number of the rollers 42 and 43 is larger, the tension that can be applied onto the web W by the load on the rollers 42 and 43 are smaller. Thus, as the number of the rollers 42 and 43 are increased, it is necessary to increase the load applied onto the movable rollers 42 which are connected together.

It is preferred that the rotation moments of the rollers 42 and 43 are small. Therefore, it is preferred that at least the movable rollers 42 and the fixed rollers 43 are made of a light-weight material such as an aluminum alloy, a resin, a carbon graphite, or the like. Note that it is more preferred that all the rollers of the splicing apparatus around which the web W is passed are made of a light-weight material.

Figure 3:
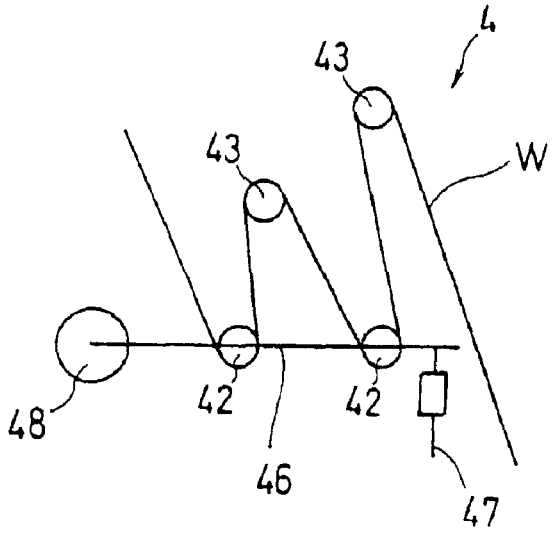
FIG. 3 is a schematic illustrating a variation of an accumulator.

The accumulator 4 may be of a type as illustrated in FIG. 1, in which the movable rollers 42 are moved up and down. Alternatively, the accumulator 4 may be of a type as illustrated in FIG. 3. The accumulator 4 illustrated in FIG. 3 includes the movable rollers 42 and the fixed rollers 43 around which the web W is passed, a supporting rod 46 to which the movable rollers 42 are attached, and a pivoting section 48 allowing for a pivotal movement of the supporting rod 46. The web W may be placed under tension by the self-weight of the supporting rod 46, etc. Alternatively, an elastic member 47 such as a spring or a damper, or a weight, may be attached to the supporting rod 46 for applying a predetermined tension on the web W. It is preferred that the elastic member 47 is attached at or near one end of the supporting rod 46 that is opposite from the pivoting section 48. When the least amount of the web W is stored in the accumulator, the centers of rotation of the movable rollers 42 may be aligned with those of the fixed rollers 43.

Moreover, the movable rollers 42 may cross a phantom field through which centers of rotation of the fixed rollers 43 pass, thereby saving time for putting the web W on the rollers 42 and 43. For example, after the movable rollers 42 cross the phantom field, the web W can pass between the fixed rollers 43 and the movable rollers 42. When the movable rollers 42 cross the phantom field again, the web W passes in a zigzag shape on the rollers 42 and 43.

The pivoting section 48 may include a sensor (not shown) for detecting an angle of the supporting rod 46. The sensor, for example, may be a potentiometer.

The splicing apparatus of FIG. 1 includes a controller 5 for controlling the first and second drivers 1A and 1B. The controller 5 is operable to spin the first and second drivers 1A and 1B at a predetermined speed. For example, in a case where a single motor (not shown) is used, the controller 5 controls the rotational speed of the motor, while a driving force of the motor is given to the first driver 1A or the second driver 1B by using a clutch, or the like. In a case where a motor (not shown) is provided for each web roll (A and B), the controller 5 separately controls the rotational speed of each motor.

An exemplary splicing method will now be described.

The present apparatus alternately transfers the webs Wa and Wb while connecting them together as described above. For the purpose of illustration, it is assumed in the following description that the second web Wb is connected to the first web Wa.

Normally, the accumulator 4 stores an average amount of the first web Wa (or the second web Wb) between the maximum amount and the minimum amount of the web Wa that can be stored therein, so that fluctuations in the amount of the first web Wa supplied can be optimally accommodated. Before the webs Wa and Wb are spliced together, the controller 5 increases the rotational speed of the first driver 1A so that a predetermined amount of the first web Wa that is greater than the above-mentioned average amount is stored in the accumulator 4. The predetermined amount may be of any value as long as it provides a sufficient amount of extra time for splicing the first web Wa and the second web Wb together.

The controller 5 turns OFF the first driver 1A when the predetermined amount of the first web Wa is stored in the accumulator 4 in preparation for the splicing of the webs Wa and Wb. When the first roll A stops spinning, the controller 5 controls the splicer 3 so that the splicer 3 splices the second web Wb to the first web Wa and cuts off the first web Wa. The amount of the first web Wa stored in the accumulator 4 decreases during the splicing operation. After the first web Wa is cut off, the controller 5 turns ON the second driver 1B. Thus, the state of the accumulator 4 changes during the web splicing process.

Then, the controller 5 drives the second driver 1B so that the average amount of the second web Wb is stored in the accumulator 4. The amount of the second web Wb (or the first web Wa) stored in the accumulator 4 may be controlled to target the average amount by using a feedback control, for example. Specifically, the rotational speed of the second driver 1B may be determined based on a deviation between a target position (level) of the movable rollers 42 and an actual position thereof.

Alternatively, the controller 5 may determine a new rotational speed of the second driver 1B based on the deviation between the target position of the movable rollers 42 and the actual position thereof, and an amount of change in the rotational speed of the second driver 1B.

Alternatively, the controller 5 may determine the new rotational speed of the second driver 1B based on the deviation between the target position of the movable rollers 42 and the actual position thereof, and information regarding the rotational speed of the second driver 1B.

Alternatively, the controller 5 may determine the new rotational speed of the second driver 1B based on the deviation between the target position of the movable rollers 42 and the actual position thereof, and a rate of positional change of the movable rollers 42 (i.e., the velocity at which the frame 45 is moved up or down).

Alternatively, the controller 5 may determine the new rotational speed of the second driver 1B based on the deviation between the target position of the movable rollers 42 and the actual position thereof, the rate of positional change of the movable rollers 42, and information regarding the rotational speed of the second driver 1B.

A circumferential velocity of the second roll B can be obtained by multiplying an angular velocity of the second driver 1B by the radius of the roll B.

The radius of the roll B may be input to the controller 5 in advance by an operator. However, such an input operation may be time-consuming.

Alternatively, the diameter of the roll B may be obtained by providing a sensor for measuring the diameter of the roll B. However, this requires the provision of the sensor for measuring the diameter or radius of the roll B, thereby increasing the cost. Thus, the controller 5 may calculate the diameter of the roll B based on information regarding the rate of positional change of the movable rollers 42, thereby eliminating the time-consuming input operation while reducing the cost. In such a case, the splicing apparatus includes a sensor S for measuring the position of the movable rollers 42.

An exemplary method for calculating the diameter of the roll B (A) based on a state of the accumulator will now be described. The state of the accumulator changes according to the amount of a web supplied into the accumulator and the amount of a web output from the accumulator, after the webs are spliced together and the appropriate driver starts spinning.

An amount X of the web W stored in the accumulator 4 at a given time (t) is expressed by Expression (1) below.

$$X(t)=\int V_I(t)dt-\int V_O(t)dt+\alpha \quad (1)$$

Where $\alpha$ is the amount of the web W that is already stored in the accumulator, $V_I(t)$ is the supply velocity at which the web is supplied to the accumulator, $V_O(t)$ is the line or output velocity at which the web is output from the accumulator (normally, the output velocity is equal to the line velocity, and is thus constant).

The relationship between the position P of the movable rollers 42 and the amount X(t) of the web W stored is X=f(P). With the accumulator 4 of the type as illustrated in FIG. 1, the position P and the amount X are generally in proportion to each other. Therefore, a formula X=a·P (where "a" is a constant) may be used. Alternatively, the relationship between the position P and the amount X may be stored in the controller 5 as a table. With an accumulator of the type as illustrated in FIG. 3, the amount X may be geometrically calculated from the position P by the controller 5. Alternatively, the relationship between the position P and the amount X may be stored in the controller 5 as a table. In order to perform the operation in a short period of time, it is preferred that the relationship between the position P and the amount X be stored as a table. Note that the relationship between the position P and the amount X can be obtained in advance by an experiment.

On the other hand, the supply or feeding velocity $V_I(t)$ can be obtained as shown in Expression (2) below.

$$V_I(t)=R\cdot\theta(t) \quad (2)$$

Where R is the radius of the roll B, and $\theta(t)$ is the angular velocity of the second driver 1B.

On the other hand, the line velocity $V_O(t)$ can be known from the information from the encoder for measuring the velocity of the web W or the turns of the motor for moving the web W. Thus, the controller 5 can calculate the radius R of the roll B based on Expressions (1) and (2), etc. Note that even if $\alpha$ is unknown, it can be canceled out by measuring the positions P of the movable rollers 42 at different times, whereby the radius R of the roll B (A) can still be obtained from these expressions.

A principle of obtaining the radius R will now be described with reference to FIG. 2.

Figure 2:
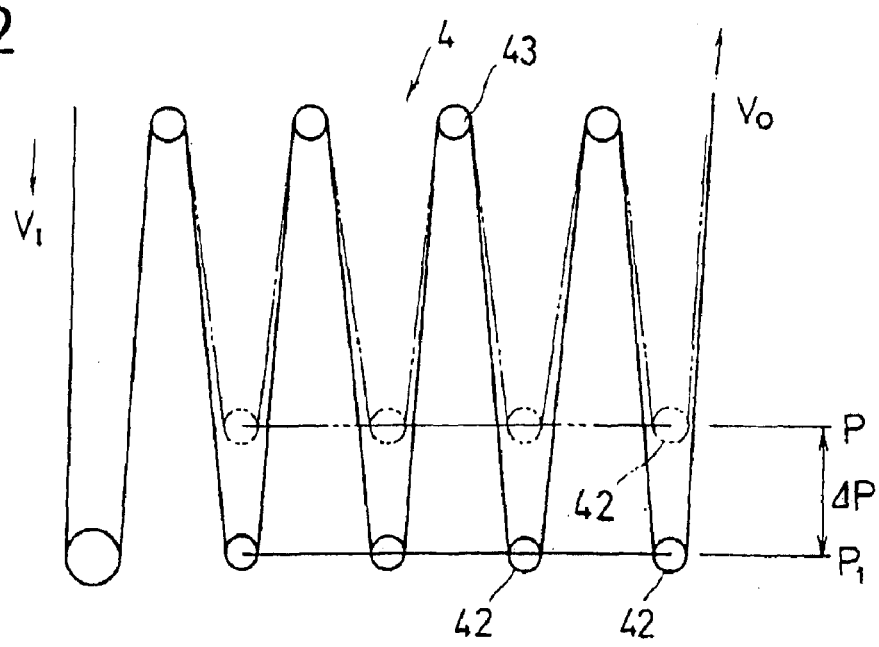
FIG. 2 is a diagram illustrating a principle of obtaining the diameter of a roll.

Assume that the accumulator 4 is in a position as indicated by a two-dot chain line in FIG. 2, the amount of the web W that is already stored in the accumulator 4 is $\alpha$, the amount of the web W that will be stored therein after the passage of a minute period $\Delta T$ is $\alpha_1$, and a displacement of the movable rollers 42 over the minute period $\Delta T$ is $\Delta P$. Then, the displacement $X\Delta T$ between the amount of the web W stored in the accumulator 4 at a point in time and that after the passage of the minute period $\Delta T$ can be expressed by Expression (11) below.

$$\Delta P=X\Delta T=\alpha_1-\alpha \quad (11)$$

In Expression (11), the amounts $\alpha$ and $\alpha_1$ can be obtained from the levels P and $P_1$, respectively, of the movable rollers 42. Therefore, the displacement $X\Delta T$ can be obtained from the displacement $\Delta P$ of the movable rollers 42.

The displacement $X\Delta T$ may also be expressed by Expression (12) below.

$$\Delta P = X\Delta T = W_{IN} - W_{OUT} \quad (12)$$

Where $W_{IN}$ is the amount of the web supplied to the accumulator 4 for $\Delta T$, and $W_{OUT}$ is the amount of the web output from the accumulator for $\Delta T$.

In Expression (12), the amount $W_{OUT}$ of the web output can be obtained by multiplying the line velocity (constant) by the minute period $\Delta T$, and the displacement $X\Delta T$ can be known from Expression (11). Therefore, the amount $W_{IN}$ of the web supplied to the accumulator 4 can be obtained. The obtained amount $W_{IN}$ of the web supplied can be divided by the minute period $\Delta T$ to obtain the feeding velocity $V_1(t)$ at which the web is fed from a roll A or B. Therefore, the radius R of the roll A or B can be obtained by dividing the feeding velocity $V_1(t)$ by the angular velocity $\theta(t)$ of the driver 1A or 1B.

During a normal operation of the present splicing apparatus, where the webs W are not being spliced, the web W may be fed out while the diameter of the roll is not directly measured. Herein, the "normal operation" refers to a mode of operation where a predetermined amount of the web W is stored in the accumulator after a web splicing operation has been completed, and the splicing apparatus is feeding out the web W from a roll A or B.

A method for obtaining the radius of the roll during the normal operation in a case where the web W is fed out at a predetermined velocity will now be described.

A thickness $T_W$ of the web W is generally constant. Therefore, the radius of the roll B decreases by the thickness of the web W for each turn of the roll B. Therefore, the current radius R of the roll B can be known from Expression (3) below.

$$R = R_{IN} - T_W \cdot N \quad (3)$$

Where $R_{IN}$ is the radius of the roll B (A) upon completion of a web splicing operation, $T_W$ is the thickness of the web W, and N is a number of turns the roll B (A) has been spun.

Note that also in the normal operation, the diameter of the roll B can be obtained from the position P of the movable rollers 42 while increasing the velocity at which the web W is fed, although this will fluctuate the amount of the web W stored in the accumulator 4.

As described above, according to the present invention, the position of the movable rollers is detected, and the diameter of the roll A or B is obtained based on the positional change of the movable rollers 42, i.e., the velocity at which the movable rollers are moved, whereby it is possible to obtain the diameter of the roll even during a web splicing operation. Therefore, the speed of the driver 1A or 1B can be controlled at an appropriate value based on the diameter of the roll A or B, whereby it is possible to perform a web splicing operation while maintaining a predetermined tension on the web W being fed out and without changing the line velocity $V_O$ of the web downstream of the accumulator 4 after the web splicing operation.

Moreover, the positional change of the movable rollers 42 is much easier to detect than the velocity of the web W. Furthermore, for any splicing apparatus, it is advantageous to detect the position P of the movable rollers 42. Therefore, by using the position P of the movable rollers 42, it is possible to avoid the provision of a new sensor, thereby reducing the cost.

What is claimed is:

1. A splicing apparatus, comprising:

a first driver operable to spin a first roll of web;

a second driver operable to spin a second roll of web;

a splicer operable to connect a second web fed out from the second roll to a first web fed out from the first roll, and cut off the first web;

an accumulator comprising a movable roller and a fixed roller, the accumulator operable to store at least one of the first web and the second web between the movable roller and the fixed roller;

a first sensor operable to sense a position of the movable roller;

a second sensor operable to sense rotation information regarding a rotation of the second driver per unit time; and a controller operable to control a rotational speed of the first driver and that of the second driver, wherein the controller is operable to calculate the rotational speed of the second driver based on a positional change of the movable roller, rotation information of the second driver and a web flow velocity at a position downstream of the accumulator, and operable to control the second driver according to the calculated rotational speed.

2. The splicing apparatus according to claim 1, further comprising a third sensor for sensing rotation information regarding a rotation of the first driver per unit time, when the first web fed out from the first roll is connected to the second web fed out from the second roll, the splicer cuts off the second web, and wherein the controller is further operable to calculate the rotational speed of the first driver based on the positional change of the movable roller, the rotation information of the first driver and the web flow velocity at the position downstream of the accumulator, and is operable to control the first driver according to the calculated rotational speed.

3. The splicing apparatus according to claim 2, wherein the movable roller is made of a material including at least one of an aluminum alloy, a resin and a carbon graphite.

4. The splicing apparatus according to claim 2, wherein the first and second drivers are servo motors.

5. The splicing apparatus according to claim 2, further comprising a motor and a clutch, wherein the first and second drivers are switched from one another by the clutch and a driver to be driven by the motor.

6. The splicing apparatus according to claim 1, wherein the movable roller is made of a material including at least one of an aluminum alloy, a resin and a carbon graphite.

7. The splicing apparatus according to claim 1, wherein the first and second drivers are servo motors.

8. The splicing apparatus according to claim 1, further comprising a motor and a clutch, wherein the first and second drivers are operable to be switched from one another by the clutch as a driver and be driven by the motor.

9. A splicing apparatus, comprising:

a first driver operable to spin a first roll of web;

a second driver operable to spin a second roll of web;

a splicer operable to connect a second web fed out from the second roll to a first web fed out from the first roll, and cut off the first web;

an accumulator comprising a movable roller and a fixed roller, the accumulator operable to store at least one of the first web and the second web between the movable roller and the fixed roller;

a first sensor operable to sense a position of the movable roller;

a second sensor operable to sense spinning information regarding a number of turns the second driver is spun per unit time; and a controller operable to control a rotational speed of the first driver and that of the second driver, wherein after the first web is spliced with the second web, the controller is operable to calculate a first diameter of the second roll based on a positional change of the movable roller, information regarding an angular velocity of the second driver and a web flow velocity at a position downstream of the accumulator and wherein the controller is further operable to calculate a second diameter of the second roll based on the first diameter of the second roll, the spinning information, and an amount of time that has passed from when the first diameter of the second roll is calculated.

10. The splicing apparatus according to claim 9, further comprising a third sensor for sensing spinning information regarding a number of turns the first driver is spun per unit time, wherein after the second web is spliced with the first roll of web, the controller is operable to calculate a first diameter of the first roll based on the positional change of the movable roller, information regarding an angular velocity of the first driver and the web flow velocity at the position downstream of the accumulator, and wherein the controller is further operable to calculate a second diameter of the first roll based on the first diameter of the first roll, the spinning information, and a amount of time that has passed from when the first diameter of the first roll is calculated.

11. The splicing apparatus according to claim 10, wherein the movable roller is made of a material including at least one of an aluminum alloy, a resin and a carbon graphite.

12. The splicing apparatus according to claim 10, wherein the first and second drivers are servo motors.

13. The splicing apparatus according to claim 10, further comprising a motor and a clutch, wherein the first and second drivers are switched from one another by the clutch as a driver to be driven by the motor.

14. The splicing apparatus according to claim 9, wherein the movable roller is made of a material including at least one of an aluminum alloy, a resin and a carbon graphite.

15. The splicing apparatus according to claim 9, wherein the first and second drivers are servo motors.

16. The splicing apparatus according to claim 9, further comprising a motor and a clutch, wherein the first and second drivers are operable to be switched from one another by the clutch as a driver and be driven by the motor.

* * * * *